US008104949B2

(12) United States Patent
Robinson et al.

(10) Patent No.: US 8,104,949 B2
(45) Date of Patent: Jan. 31, 2012

(54) TIME INDICATOR DEVICE

(75) Inventors: John Robinson, Rochdale (GB); Alexander Roy McLennan, Wilmslow (GB); Nicholas Edward Richardson, MacClesfield (GB)

(73) Assignee: Intray Limited, Cheshire (GB)

( * ) Notice: Subject to any disclaimer, the term of this patent is extended or adjusted under 35 U.S.C. 154(b) by 132 days.

(21) Appl. No.: 12/680,388

(22) PCT Filed: Sep. 26, 2008

(86) PCT No.: PCT/GB2008/003279

§ 371 (c)(1),
(2), (4) Date: Mar. 26, 2010

(87) PCT Pub. No.: WO2009/040547

PCT Pub. Date: Apr. 2, 2009

(65) Prior Publication Data

US 2010/0322037 A1 Dec. 23, 2010

(30) Foreign Application Priority Data

Sep. 26, 2007 (GB) ..... 0718816.2

(51) Int. Cl.
*G04F 1/00* (2006.01)

(52) U.S. Cl. ..... 368/89; 368/327

(58) Field of Classification Search ..... 368/327, 368/89

See application file for complete search history.

(56) References Cited

U.S. PATENT DOCUMENTS

| | | | | |
|---|---|---|---|---|
| 3,954,011 | A * | 5/1976 | Manske | 374/102 |
| 4,028,876 | A * | 6/1977 | Delatorre | 368/89 |
| 6,231,229 | B1 | 5/2001 | Halderman | |
| 6,452,873 | B1 | 9/2002 | Holt et al. | |
| 7,280,441 | B2 * | 10/2007 | MacDonald et al. | 368/327 |
| 7,514,262 | B2 * | 4/2009 | Ribi | 436/2 |
| 7,517,146 | B2 * | 4/2009 | Smith et al. | 374/162 |
| 7,593,290 | B2 * | 9/2009 | Stange et al. | 368/10 |

FOREIGN PATENT DOCUMENTS

| | | |
|---|---|---|
| JP | 61099829 | 5/1986 |
| WO | WO9205415 | 4/1992 |
| WO | 9209870 | 6/1992 |
| WO | WO9628714 | 9/1996 |
| WO | 2006077413 | 7/2006 |

OTHER PUBLICATIONS

International Search Report for Application No. PCT/GB2008/003279 dated Jul. 20, 2009 (5 pages).

* cited by examiner

*Primary Examiner* — Sean Kayes
(74) *Attorney, Agent, or Firm* — Michael Best & Friedrich LLP

(57) ABSTRACT

A time indicator device comprised of first and second interconnected reservoirs containing first and second liquids respectively. A first barrier is provided between said first and second liquids to prevent said liquids mixing. Said first barrier is connected via a conduit to a third reservoir containing a third liquid which is adapted to pass along said conduit over a first predetermined time period and to effect removal of said first barrier upon contact to facilitate mixing of said first and second liquid and generation of a liquid mixture within the second reservoir of different color to the second liquid prior to mixing and thereby provide an indication of when said first predetermined time period has elapsed.

25 Claims, 4 Drawing Sheets

TIME INDICATOR DEVICE

CROSS-REFERENCE TO RELATED APPLICATIONS

This patent application is a national stage filing under 35 U.S.C. 371 of International Application No. PCT/GB2008/003279, filed 26 Sep. 2008, which claims foreign priority to Great Britain Patent Application No. 0718816.2, filed 26 Sep. 2007, each of which is incorporated herein in its entirety. Priority is hereby claimed to each of these applications.

The present invention relates to a time indicator device, particularly but not exclusively, a time indicator device suitable for use on food and other perishable products, such as pharmaceuticals and cosmetics.

The present invention will be described with reference to its use on food products, however it is recognised and will be readily apparent that the invention could also find application in other fields such as pharmaceutical products, cosmetics and any other products which have a limited open life.

There are currently a number of different target dates provided to the consumer as indicators of the likely level of freshness of food (and other perishable) products. The current practice is to provide one or more of the following: a 'Sell By' date; a 'Best Before' date; a 'Use by' date; and/or a 'Once opened, use within' date.

A 'Sell By' date, the date after which the retailer should no longer offer a product for sale. This is an indicator to the retailer of the expected shelf life of a product, but provides the consumer with no useful information as to how long after this date a product is still safe or desirable to consume.

A 'Best Before' date, the date after which the product may not be at its premium quality of performance. This does provide the consumer with an indication of the 'best product life', but is not an indicator of the actual freshness or performance of a product. Furthermore, this date is generally only a reliable measure if the primary packaging is in an unopened state and the product has been stored properly.

A 'Use by' date, the date after which a product is notionally no longer safe to consume (the product may still be safe, but the retailer/manufacturer will no longer warrant such). Again, this date relies on the integrity of the primary product packaging and also appropriate storage conditions.

A 'Once opened, use within XX days' date, this date attempts to reflect the accelerated decay of the produce following breach of the primary packaging. Whilst the use of a 'Once opened, use within XX days' date is an advance on the previous state of the art, but its effectiveness relies totally on the consumer remembering when a product was first opened. This is fine when the open life is short (e.g. 3 days for orange juice); however, some products have an open life of several weeks or even months, at which point the consumer's memory becomes an unreliable measure, with people tending to rely on the smell of the product or assuming it will be alright and using it anyway. This is unsatisfactory both for the consumer, who will get poor performance from the product, may suffer an upset stomach or other complaint as a result of eating tainted food, and also for the manufacturer, who will probably lose a future customer, due to their dissatisfaction with the product. This date also relies on the produce being stored in appropriate conditions after opening.

Clearly there is a need, both from the manufacturer's and the consumer's perspective, for a simple, inexpensive and reliable indicator for such perishable product containers in order to better safeguard the consumer's health and also to improve customer perception of the manufacturers. A number of means to accomplish this objective have been attempted in the past and are known in the art; however, all have their drawbacks.

In some earlier devices the timer is started upon manufacture or application of the device, whereas in other devices user initiation is employed. Both these systems have inherent problems, certain devices are fine as 'Use By' indicators, but due to their initiation at manufacture can take no account of the accelerated rate of product decay upon breach of primary packaging exposing the product to oxygen, locally introduced bacteria and other suchlike present in the atmosphere. Equally the user-activated devices rely on a consumer remembering to activate the device upon opening their product, this is easily forgotten and could leave unaffected exactly the problems they are intended to address.

A few attempts have been made to address the aforementioned shortcomings of the above products. For example, a reservoir may be breached by the act of opening the closure/lid of a container holding the perishable product. A multi-component lid can be used with various moving parts designed to puncture a reservoir containing a reactive compound. These devices borrow heavily from known art in the field of tamper evidence and suffer from the same main drawback, which is that a multi-component lid/closure is difficult to manufacture and assemble and therefore too costly to gain mainstream commercial acceptance.

An object of the present invention is to obviate or mitigate one or more of the problems and/or drawbacks associated with prior art time indicator devices mentioned above.

According to a first aspect of the present invention there is provided a time indicator device comprised of first and second interconnected reservoirs containing first and second liquids respectively, a first barrier being provided between said first and second liquids to prevent said liquids mixing, wherein said first barrier is connected via a conduit to a third reservoir containing a third liquid which is adapted to pass along said conduit over a first predetermined time period and to effect removal of said first barrier upon contact to facilitate mixing of said first and second liquids and generation of a liquid mixture within the second reservoir of different colour to the second liquid prior to mixing and thereby provide an indication of when said first predetermined time period has elapsed.

The present invention thus provides a means of providing a consumer with a clear and reliable visual indication of how safe a particular perishable item, such as a foodstuff, pharmaceutical or cosmetic, is to use.

The first predetermined time period is controlled primarily by the rate at which the third liquid passes along the conduit from the third reservoir to the first barrier. Once the third liquid has passed along the conduit and reaches the first barrier, contact between the third liquid and the first barrier causes the first barrier to be removed, thereby releasing the first and second liquids so that they can mix together and produce a liquid mixture of different colour to the original colour of the second liquid before mixing.

By way of example, in a preferred embodiment the second liquid contains a Universal pH indicator solution and is initially green in colour by virtue of possessing an approximately neutral pH (i.e. around pH 7). Once the time indicator device is activated (e.g. by opening a jar containing a perishable food item), the third liquid passes down the conduit over the first predetermined time period until it contacts the first barrier, causing the barrier to be removed and allowing the first liquid to mix with the green second liquid. In this embodiment, the first liquid contains a suitable amount of a food-safe acid compound which, when mixed with the second liquid containing the pH indicator solution, produces a liquid mixture which is more acidic than the original neutral second liquid. In this way, the user can observe a change in colour of the liquid present in the second reservoir from green to red indicating that the first predetermined time period has elapsed and that the perishable food item is no longer safe to be consumed.

In an alternative embodiment the second liquid is clear but is supported within the second reservoir on a green-coloured backing layer so as to present a green colouration to the user. In this embodiment, colourants, such as dyes and/or pigments, can be used to provide the necessary colour changes to indicate when a perishable item has passed its use-by date. For example, the first liquid can be provided with a red dye which, when mixed with the second liquid within the second reservoir, causes the resulting liquid mixture within the second reservoir to exhibit a red colouration indicating that the item is no longer suitable for use. In further embodiments, the first liquid may contain both an amount of acid and a colourant to ensure that the appropriate colouration is afforded to the user.

It should also be appreciated that the first aspect of the present invention is not limited to just a single colour change from, e.g. green to red, but that any desirable colour change may be utilised. For example, as described in more detail below, the second reservoir can be connected to at least one further reservoir and mixing of the contents of the further reservoir(s) with the liquid within the second reservoir controlled in a similar manner to the first liquid such that the colour of the liquid mixture within the second reservoir can be changed after not only a first time period, but also after a second, and optionally further, time periods. Thus, in another preferred embodiment the second reservoir is connected to two reservoirs and mixing of the liquids in the two reservoirs with the liquid within the second reservoir occurs over two different time periods. In this way, a two-step colour change can be employed to indicate firstly when a perishable item has begun to perish but is still suitable for use, and secondly, when the item has perished to such an extent that it is deemed no longer suitable to use. A simple and universally recognised two-step colour change indicator is the "traffic-light" indicator system whereby a green colouration initially changes to an amber colouration, indicating a warning of some sort, followed by a second colour change to a red colouration. The preferred embodiment of the present invention mentioned above in which two reservoirs are connected to the second reservoir can therefore employ the "traffic-light" warning system to provide a user with an initial colour change from green to amber to indicate that an item, while still fit for purpose, has begun to perish, followed by a further colour change from amber to red to indicate that the item should no longer be used.

A second aspect of the present invention provides a time indicator device comprised of first and second interconnected reservoirs containing first and second liquids respectively, and a barrier being provided between said first and second liquids to prevent said liquids mixing, wherein the barrier comprises a chemically and/or enzymatically degradable substance which is adapted to be sufficiently degradable after a first predetermined time period to permit the first and second liquids to mix and generate a liquid mixture within the second reservoir of different colour to the second liquid prior to mixing and thereby provide an indication of when said first predetermined time period has elapsed.

The second aspect of the present invention relates to a time indicator device in which at least two liquids are prevented from mixing by a particular type of barrier until a predetermined time period has elapsed. This aspect of the invention provides a chemically and/or enzymatically degradable barrier between the at least two liquids, thereby enabling timing to be controlled by the rate at which a suitable chemical agent or enzyme passes from a reservoir to the barrier and initiates the barrier's degradation and/or by the rate at which the chemical agent or enzyme degrades the barrier following initial contact. This provides the designer/manufacturer of the device with a great deal of flexibility in how best to arrange the components of the device to suit its intended purpose. By way of example, in some applications it may be appropriate to control timing by having the chemical agent/enzyme pass along a conduit of a particular length after activation of the device such that the distance over which the chemical agent/enzyme travels from its reservoir to the barrier essentially determines the first predetermined time period. In other applications, it may be appropriate to control timing by selecting a chemical agent/enzyme which contacts the barrier almost instantaneously after activation of the device but degrades the barrier over an extended period of time equivalent to the first predetermined time period. In still further applications a combination of the above timing mechanisms may be employed such that a predetermined time period is controlled both by the rate at which the chemical agent/enzyme passes along a conduit and the rate at which the chemical agent/enzyme degrades the barrier.

According to a third aspect of the present invention there is provided a time indicator device comprised of a first reservoir containing a first liquid comprising a colourant and a second reservoir containing a second liquid comprising a dispersant for said colourant, a viewing window being associated with said second reservoir, said first and second reservoirs being interconnected by a conduit, and a barrier being provided between at least one of said first and second liquids and said conduit, wherein the conduit contains a first substance that is a liquid or gel, and removal of the barrier permits dispersion of said colourant from the first reservoir to the second reservoir over a predetermined time period thereby providing an indication via said viewing window of when said predetermined time period has elapsed.

By connecting the first and second reservoirs with a conduit which contains a liquid or gel as in the third aspect of the present invention any potential problems associated with the use of gas (e.g. air) filled conduits linking the two reservoirs are avoided. Since the movement of the colourant species within the liquid mixture formed throughout the reservoirs and conduit(s) does not rely solely upon the flow of fluids (i.e. liquids or gases) within the device, fluid dynamic and fluid displacement issues associated with some earlier devices are avoided.

It is envisaged that dispersion of the colourant from the first reservoir to the second reservoir may be controlled, at least in part, by providing a higher concentration of the colourant in the first reservoir than in the second reservoir. This may, of course, be achieved by providing a predetermined concentration of the colourant in the first reservoir and no colourant in the second reservoir, although the present invention is not limited to this particular configuration. The same or different colourants may be provided in both the first and second reservoirs, but the relative concentrations of the colourants in the two reservoirs may be selected so as to ensure that the colourant in the first reservoir has a tendency to disperse from the first reservoir into the second reservoir.

The term 'colourant' as used herein is intended to refer to any substance which provides colouration and, when used without further qualification, encompasses both dyes and pigments.

The term 'dispersant' as used herein refers to any substance which is capable of dispersing or dissolving a first entity, such as but not limited to a dye or pigment, in a second entity, such as but not limited to a liquid, for example water. When used without further qualification the term 'dispersant' should be understood as encompassing substances which dissolve, partially dissolve or disperse the first entity in the second entity. In this way, the term 'dispersant' encompasses but is not limited to a solvent for a particular substance.

The term 'conduit' as used herein refers to any type of passageway along which a liquid can flow or molecules can pass and is not intended to be restricted to tubes, channels or capillaries of circular cross section. Where the term 'conduit' is used without further qualification, the term in intended to encompass passageways which may be open or closed along at least a part of their length and which are of appropriate dimension and construction to permit liquid flow.

The term 'liquid' as used herein in no way implies any restriction to a pure liquid and is intended to encompass liquid mixtures or solutions, as well as pure liquids. The term should be interpreted broadly, suggesting only that the substance discussed is liquid in nature, i.e. it is a non-gaseous fluid with flow characteristics. The terms 'gel' and 'gel-like' used herein will be understood as referring to an apparently solid, often jelly-like material, the composition of which is typically mostly liquid and thus possesses a density similar to a liquid, but possess the structural coherence of a solid.

It will be further appreciated that reference above to just two reservoirs and one conduit in no way limits the present invention to such arrangements and that it is envisaged that the indicator device of the present invention may incorporate any desirable number of reservoirs and/or conduits. Moreover, reference above to just two liquids contained in the reservoirs and a single liquid or gel contained in the conduit should not be interpreted as limiting the present invention to such arrangements and that any number of different liquids, possibly in combination with further substances (e.g. one or more gels) may be provided in each reservoir and the or each conduit.

The time indicator device of the present invention may be provided in the form of a label or tag to be affixed to a perishable item or product, or it may be incorporated directly into the product packaging. For example, the device may be incorporated into a laminated sheet of material which is then wrapped around the item or product, or which is formed as a sleeve of material and wrapped around further product packaging.

In the first and second aspects of the present invention it is preferred that a second barrier is provided between the third reservoir and the conduit. The second barrier is preferably adapted such that, upon removal, the first predetermined time period is initiated by permitting the passage of the third liquid along the conduit. The second barrier may be adapted to be removable as a result of opening a product to which the device is attached and/or removable as a result of attaching the device to a product.

In a particularly preferred embodiment of the first aspect of the present invention the first barrier comprises a chemically and/or enzymatically degradable substance.

In both the first and second embodiments of the present invention in which the first barrier incorporates a chemically and/or enzymatically degradable substance any appropriate substance may be used provided it can satisfactorily prevent mixing of the first and second liquids until degradation by a chemical agent or enzyme. By way of example the substance may be a relatively high molecular weight compound or polymer, which may be either natural, synthetic (i.e. artificial) or semi-synthetic. A particularly suitable substance is a lipid. Thus, preferred substances are lipophilic species, including fats, oils (e.g. hard palm kernel oil), waxes, and glycerides (mono-, di- and tri-glycerides).

Preferably the degradable substance has a relatively high viscosity, preferably higher than the first, second and/or third liquids. In a preferred embodiment the viscosity of the degradable substance comprised in the first barrier is at least around 2000 cP (at 20° C.), more preferably at least around 4000 cP (at 20° C.), and most preferably at least around 10000 cP (at 20° C.). In further preferred embodiments the viscosity of the degradable substance is around 5000 to around 20000 cP (at 20° C.).

In some applications it will be desirable that the degradable substance possesses a melting point above around 40° C., more preferably above around 60° C., and still more preferably above around 80° C. In other application it will be desirable that the degradable substance has a lower melting point, such as around 5 to 10° C. or lower, for example when it is desirable to have the degradable substance melt and the barrier therefore fail at relatively low temperatures. Exemplary applications requiring a lower melting point degradable substance include use on frozen or chilled goods where it is desirable for the device to indicate that the goods have been thawed out or warmed beyond the melting point of the degradable substance and subsequently refrozen or rechilled.

The degradable substance may be at least partially foamed, i.e. at least partly in the form of a foam, so as to increase its surface area compared to the substance when unfoamed. In this way, the surface area of the substance available to contact the chemical agent/enzyme is increased which may increase the rate at which degradation of the barrier takes place facilitating essentially instantaneous degradation in some applications. It may also be possible to use a smaller amount of the degradable substance if it is foamed than unfoamed, which would be desirable from a cost and environmental point of view, as well as reducing the weight of the barrier.

In further preferred embodiments of the first and second aspects of the present invention the first barrier comprises a dehydrated enzyme capable, upon hydration, of degrading the degradable substance also comprised in the first barrier. While any appropriate dehydrated enzyme may be used it is particularly preferred that the dehydrated enzyme is a lipase.

In the first aspect of the present invention the first barrier is connected via a conduit to a third reservoir containing a third liquid and the time taken for the third liquid to pass along the conduit contributes to determining the first predetermined time period. The conduit may contain any desirable substance in any appropriate physical state. Thus, while it is possible that the conduit may contain a gas such as air, it is preferred that the conduit contains substantially no gas and instead contains a liquid or gel whose properties may contribute to controlling the speed at which the third liquid passes along the conduit from the third reservoir to the first barrier.

It is preferred that the first substance in the conduit exhibits a higher viscosity than the first and/or second liquids. The viscosity of the first substance may be greater than around 100 cP (at 20° C.), greater than around 300 cP (at 20° C.), and more preferably greater than around 1000 cP (at 20° C.). In further preferred embodiments, the first substance has a viscosity which is in the range of around 500 to around 2000 cP (at 20° C.), more preferably around 700 to 1400 cP (at 20° C.).

The first substance may comprise any suitable to chemical to bestow the desired physical and/or chemical characteristics to the first substance to control passage of the third liquid along the conduit. Preferably the first substance within the conduit comprises carboxymethyl cellulose (or a salt thereof), hydroxyethyl cellulose, glycerol; ethylene glycol, diethylene glycol or mixtures thereof. The composition of the first substance, e.g. the weight percentage of each component, may be selected to suit a particular application and may be selected from the compositions described below in relation to the third aspect of the present invention for the composition of the first higher viscosity substance employed in that device.

Preferably the third liquid is substantially miscible with the first substance and/or the third liquid comprises a solvent or dispersant for the first substance. In this way, the third liquid can mix with the first substance to a satisfactory extent such that the third liquid can, over a predetermined time period, pass along the conduit from the third reservoir to the barrier and then effect removal of the barrier.

Preferably the third liquid comprises a chemical species or enzyme capable of degrading the degradable substance comprised in the first barrier. In this way, once the third liquid has passed along the conduit and contacts the first barrier, degradation of the barrier is initiated. The third liquid may include any desirable component, but it is preferred that it comprises water since water is safe, cheap and acts as a good solvent for many other components that one may wish to provide in the third liquid. It is particularly preferred that the third liquid comprises saline solution. One reason for favouring saline is that it provides a stable environment for many chemical species and enzymes which may be contained within the third liquid. Any appropriate enzyme may be used and a preferred enzyme is a lipase.

With regard to the first and second aspects of the present invention the viscosity of at least one of the first and second liquids is preferably greater than around 1 cP (at 20° C.), more preferably greater than around 3 cP (at 20° C.) and most preferably greater than around 8 cP (at 20° C.). At least one of the first and second liquids may have a viscosity of around 1 to 100 cP (at 20° C.), more preferably around 1 to 50 cP (at 20° C.) and most preferably around 10 cP (at 20° C.).

The first and second liquids may contain any desirable combination of components to suit a particular application. By way of example, at least one of the first and second liquids may comprise water; preferably both the first and second liquids comprise water. The second liquid preferably comprises a pH indicator species (e.g. a Universal pH indicator). Moreover, it is preferred that the first liquid comprises an acid whose presence in the liquid mixture produced by mixing the first and second liquids can be detected by virtue of the presence of the pH indicator in the second liquid. In this way, mixing of the first and second liquids could be used to effect a change in pH of the liquid within the second reservoir which could be identified by the user as a change in colour of the liquid within the second reservoir after mixing.

Preferably the first liquid comprises a sufficient quantity of the acid such that, after mixing with the second liquid, the resulting liquid mixture within the second reservoir is more acidic than the second liquid before mixing. In a preferred embodiment, the second liquid is initially at approximately neutral pH, i.e. around pH 7, but, after mixing the first and second liquids, the resulting liquid mixture has a pH of less than 7.By way of example, the liquid mixture may be moderately acidic, e.g. a pH less than around pH 7 but higher than around pH 2; or a pH in the range of around 3 to around 6. By way of a further example, the liquid mixture may be more strongly acidic and possess a pH of less than around 2, for example a pH of around 1. It will be appreciated that in embodiments of the present invention where only a single colour change is being used to signify that a particular product is no longer suitable for use, a colour change to red may be the most appropriate option. Thus, in this embodiment, it may be desirable to use a sufficient quantity of an acid to effect a pH change from around neutral, pH 7 (green) to strongly acidic, pH 1 or 2 (red). In an alternative embodiment where a double colour change is being used to provide an initial warning followed by a final signal to stop using a product, it may be desirable to use a sufficient quantity of acid initially to cause a reduction in pH from neutral, pH 7 (green) to moderately acidic, around pH 3 to 6 (amber), followed by a sufficient quantity of acid to cause a further reduction in pH from moderately acidic (amber) to strongly acidic, around pH 1 or 2 (red).

While any desirable acid may be used, it is preferred that an acid safe for use in consumer products, such as foodstuffs is used, e.g. a food acid, such as acetic acid or citric acid.

With regard to the first and second aspects of the present invention the first liquid preferably comprises a colourant, which may be a dye or a pigment, that affords any desirable colouration to the device for identification by a user. Exemplary colourants that may be used include those providing an amber or red colouration, which would clearly be desirable if the device was intended make use of the "traffic-light" colour warning system.

At least one of the first, second and third liquids may comprise any additional or alternative components such as fluorescent species to afford the desired indicator that a predetermined time period has elapsed and/or exothermic reagents which, when reacted, generate heat which may accelerate mixing of the various liquids and so, in turn, accelerate the rate of colour change.

Concerning the first aspect of the present invention, as discussed above, it is preferred that said conduit connecting the third reservoir and the first barrier possesses a predetermined length which defines a distance over which the third liquid must pass from the third reservoir to contact the first barrier, said distance at least partly determining said first predetermined time period. In some embodiments, the device may define a single conduit of the predetermined length to suit a particular application, however, in other embodiments the device may define a plurality of partial conduits which are selectively connectable to form said conduit with said predetermined length.

If the device is assembled from components which define a plurality of partial conduits of differing length then this affords the manufacturer a greater degree of flexibility in selecting the desired conduit length to ensure that the final device informs the user of the optimum predetermined time period(s) to suit the intended application of the device. This flexibility in selection of timing periods may be advantageous in allowing the conduit length to be adjusted during assembly of the device to take account of variations in the properties of other components which might influence the device timing periods, such as the viscosity of the various liquids and substances which will reside in the conduit and the three reservoirs. By way of example, if a particular batch of the first substance that is to reside initially within the conduit is found to have a higher than anticipated viscosity which would therefore be expected to impede passage of the third liquid along the conduit to a greater extent than if its viscosity was normal, then the manufacturer can select a shorter conduit length to offset this change in properties of the substance. Moreover, if the concentration of one or more constituents of the third liquid are such that the third liquid would not dissolve or disperse through the substance resident in the conduit as well as normal and so passage of the third liquid along the conduit might be slower than expected, again manufacturing parameters could be adjusted so as to select a final conduit length that is shorter than normal to ensure the final device still operates correctly.

In a preferred embodiment of the first and second aspects of the present invention a surface of the second reservoir is coloured, for example green, and the colour of said surface is visible prior to mixing of the first and second liquids. In this way, a user of the device can be presented with a first colour resulting from the coloured surface of the second reservoir before being presented with a second, and optionally further, colour(s) resulting from mixing of liquids within the second reservoir after one or more predetermined time periods.

It is preferred in the first and second aspects of the present invention that a viewing window is associated with said second reservoir such that said indication of the when the first predetermined time period has elapsed can be observed via said viewing window.

Concerning the first aspect of the present invention which relates to a time indicator device incorporating first and second reservoirs linked via a barrier which is itself connected to a third reservoir, according to a further preferred embodiment, the device comprises a fourth reservoir connected to the second reservoir, said fourth reservoir containing a fourth liquid, a third barrier being provided between said fourth liquid and the second liquid within the second reservoir to prevent said liquids mixing, said third barrier being connected via a further conduit to a fifth reservoir containing a fifth liquid which is adapted to pass along said further conduit over a second longer predetermined time period and to effect removal of said third barrier upon contact to facilitate mixing of said fourth liquid with said first liquid mixture within the second reservoir and generation of a second liquid mixture within the second reservoir of different colour to the first liquid mixture and thereby provide an indication of when said second predetermined time period has elapsed.

This preferred embodiment of the present invention thus introduces a second set of reservoirs and a barrier which employ the same general methodology as the first set defined above in the first aspect of the present invention to provide the device with the ability to provide an indication of when a second predetermined time period has elapsed, which is longer than the first time period. Since the second time period is longer than the first, the liquid residing in the second reservoir when the fourth liquid enters is the first liquid mixture generated as a result of the first and second liquids mixing after the first predetermined time period had elapsed.

The third barrier may take any convenient form but preferably comprises a chemically and/or enzymatically degradable substance, which may be the same or similar to the substance comprised in the first barrier described in detail above. In a preferred embodiment the viscosity of the degradable substance comprised in the third barrier is similar to or the same as that of the degradable substance utilised in the first barrier, thus, by way of example only, the viscosity of the degradable substance in the third barrier may be at least around 2000 cP (at 20° C.).

The third barrier may comprise a dehydrated enzyme capable, upon hydration, of degrading the degradable substance comprised in the third barrier. Once again, the nature of the dehydrated enzyme in the third barrier may be the same, similar of different to that employed in the first barrier.

The further conduit may contain a second substance that is the same or similar to the first substance provided within the conduit linking the third reservoir to the first barrier. Thus, the further conduit linking the fifth reservoir to the third barrier preferably contains a second substance that is a liquid or gel. Preferably said second, substance in the further conduit exhibits a higher viscosity than the second and/or fourth liquids. It is preferred that the fifth liquid is substantially miscible with the second substance in the further conduit and/or that the fifth liquid comprises a solvent or dispersant for the second substance in the further conduit. For the reasons elucidated above in connection with the third liquid which passes along the conduit to the first barrier, it is preferred that the fifth liquid comprises saline solution.

The fifth liquid preferably comprises a chemical species or enzyme capable of degrading the degradable substance comprised in the third barrier. To control release of the fifth liquid from the fifth reservoir it is preferred that a fourth barrier is provided between the fifth reservoir and the further conduit. The fourth barrier may take any appropriate form, although it is preferred that the fourth barrier is adapted such that, upon removal, the second predetermined time period is initiated by permitting the passage of the fifth liquid along the further conduit. In this way, once the fourth barrier is removed the fifth liquid can pass along the further conduit and eventually contact the third barrier. This contact initiates degradation of the third barrier, thereby removing the barrier between the second and fourth reservoirs and allowing the fourth liquid to mix with the first liquid mixture already resident in the second reservoir. The fourth barrier may be adapted to be removable as a result of opening a product to which the device is attached and/or removable as a result of attaching the device to a product.

The fourth liquid may have the same or similar properties to the first liquid initially resident in the first reservoir. By way of example, the viscosity of the fourth liquid is preferably in the range of around 1 to around 100 cP (at 20° C.).

As with the first liquid, the fourth liquid preferably comprises an acid. It is preferred that the fourth liquid comprises a sufficient quantity of an acid such that, after mixing with the first liquid mixture within the second reservoir, the resulting second liquid mixture within the second reservoir has a different pH (e.g. is more highly acidic) than the first liquid mixture. In the preferred embodiment where the second liquid initially resident in the second reservoir contains a pH indicator solution it will be appreciated that by causing a change in pH of the liquid resident in the second reservoir, the colour of that liquid will also change, thereby provided a means to accurately and reliably control the colouration presented to a user of the device. In connection with this concept it is preferred that the fourth liquid comprises a sufficient quantity of acid such that, after mixing with the first liquid mixture within the second reservoir, the resulting second liquid mixture within the second reservoir possesses a pH of less than or equal to around 2. As will be appreciated by the skilled person, a pH this low will cause a solution containing a Universal pH indicator solution to present a red colouration, which a user of the device can easily identify. In most, but not necessarily all, circumstances a user presented with a red colouration will understand this as an indication that the product to which the device is attached in no longer suitable for use. This will be particularly useful when using a preferred embodiment of the device in which the "traffic-light" warning system is being used as described above. Thus, in the embodiment of the device incorporating two reservoirs connected to the second reservoir containing the pH indicator solution, the device can be used to present two colour changes to the user. A first colour change from green to amber (e.g. neutral to moderately acidic) after the first shorter predetermined time period indicating that the product is perishing but still suitable to use or consume, and a second colour change from amber to red (e.g. moderately acidic to strongly acidic) after the second longer predetermined time period indicating that the product is no longer suitable to use or consume.

Additionally or alternatively to the provision of acid in the fourth liquid, the fourth liquid may comprise a colourant, such as a dye or pigment, of any desirable colour. In the preferred embodiment where acidic solutions are being used to provide colouration in a solution containing a pH indicator, it will be appreciated that it may be advantageous to incorporate a separate colourant into each of the acidic solutions to ensure that the liquid mixtures within the second reservoir resulting from mixing with the acidic solutions present the appropriate colouration to the user.

Any desirable alternative or additional species may be provided in the first or fourth liquids to bestow the appropriate colouration to the resulting liquid mixture incorporating the first or fourth liquids. By way of example, the fourth liquid may comprise a fluorescent species and/or exothermic reagents.

Just as with the conduit connecting the third reservoir to the first barrier, it is preferred that said further conduit connecting the fifth reservoir to the third barrier possesses a second predetermined length which defines a second distance over which the fifth liquid must pass from the fifth reservoir to contact the third barrier, said second distance at least partly determining said second predetermined time period. Moreover, while the further conduit may be defined by a single conduit, the device may define a plurality of partial further conduits which are selectively connectable to form said further conduit with said second predetermined length. The advantages of defining a plurality of partial conduits from which the manufacturer can chose the conduit of the most appropriate overall length are discussed in detail above.

As defined above the second aspect of the present invention provides a time indicator device comprising at least two reservoirs containing liquids which are initially prevented from mixing by a barrier which comprises a chemically and/or enzymatically degradable substance. The barrier is sufficiently degradable after a first predetermined time period to permit the first and second liquids to mix and generate a colour change which can be identified by a user as an indication of when said first predetermined time period has elapsed. The degradable barrier comprised in the second aspect of the present invention may take any of the features of the degradable barrier employed in the first aspect of the present invention as described above.

By way of example, it is preferred that the degradable substance within the degradable barrier comprises a lipid, such as a hard palm kernel oil. The viscosity of the degradable substance may take any appropriate value depending upon the intended application and the properties of other substances incorporated in the device (e.g. the viscosity of the first and second liquids). For example, the viscosity of the substance comprised in the first barrier may be at least around 2000 cP (at 20° C.), and is preferably around 5000 to around 20000 cP (at 20° C.). In certain applications it may be advantageous to provide the barrier with a degradable substance which possesses a melting point above around 60° C., while in other application it will be desirable that the degradable substance has a lower melting point, such as around 5 to 10° C. or lower. For the reasons stated above in connection with the first and third barriers employed in the device according to the first aspect of the present invention, it is preferred that the degradable substance forming part of the barrier in the second aspect of the present invention is at least partially foamed.

Preferably the first barrier used in the second aspect of the present invention comprises a dehydrated enzyme capable, upon hydration, of degrading the degradable substance comprised in the first barrier. As stated above in respect of the first aspect of the present invention, any suitable dehydrated enzyme can be used, although it is preferred that said dehydrated enzyme is a lipase.

In a further preferred embodiment, the time indicator device according to the second aspect of the present invention may comprise a fourth reservoir connected to the second reservoir, said fourth reservoir containing a fourth liquid, a third barrier being provided between said fourth liquid and the second liquid within the second reservoir to prevent said liquids mixing, said third barrier comprising a chemically and/or enzymatically degradable substance which is adapted to be sufficiently degradable after a second longer predetermined time period to permit mixing of said fourth liquid with said first liquid mixture within the second reservoir and generation of a second liquid mixture within the second reservoir of different colour to the first liquid mixture and thereby provide an indication of when said second predetermined time period has elapsed.

It will be appreciated that the chemical and/or physical properties of the fourth liquid and/or the third barrier employed in the above preferred embodiment may be the same or similar to those of the fourth liquid and/or third barrier employed in the device according to the first aspect of the present invention.

This embodiment enables a second colour change to be presented by the device of the second aspect of the present invention. In this way, the device can be used to provide a "traffic-light" type warning system, whereby a green colouration is first presented to a user from the second (unmixed) liquid initially resident within the second reservoir, followed by an amber colouration from the first liquid mixture after the first predetermined time period has elapsed, and then a red colouration from the second liquid mixture after the second predetermined time period has elapsed.

The device according to the first and second aspects of the present invention is preferably of a multi-layer construction. The multi-layer construction preferably comprises a base layer defining the reservoirs which is formed of an impermeable material, and constructed from either a single layer or a lamination of two or more component materials. The multi-layer construction preferably then comprises an intermediate layer, again formed from an impermeable material, and constructed from either a single layer or a lamination of two or more component materials so as to define the various conduits connecting the reservoirs as described above. Finally, the multi-layer construction preferably comprises an upper layer, again formed from an impermeable material, which has built up areas on its underside (i.e. the side facing the intermediate layer, which, when laminated to the intermediate layer, serve to compress and block selected areas of the conduits defined by the second layer to prevent or delay the movement of liquids within the device until the desired point of activation.

Said reservoirs and conduits are preferably formed by a combination of embossing, die cutting, lamination, ultrasonic welding and/or laser ablation processes, which are preferably inline processes.

As described above, the conduit interconnecting the third reservoir and the first barrier and the optional fifth reservoir and third barrier is/are preferably defined by a combination of a plurality of incomplete or partial conduits of varying length defined by the intermediate layer of the device. Connection of said partial conduits to form the complete conduit connecting a reservoir to its respective barrier may be achieved using any appropriate technique and is preferably achieved selective laser ablation of a "via" in the intermediate layer of the device.

The built-up area(s) within the upper layer of the device is/are preferably printed onto the underside of the upper layer using a high viscosity ink, a process which is preferably carried out inline.

While the volume of the various reservoirs will be chosen so as to suit a particular application and combination of materials, said volume is preferably considerably greater than the volume of the conduits interconnecting the third and optional fifth reservoirs and their respective barriers. Preferably each reservoir possesses a volume that is at least 10 times greater, more preferably at least 20 times greater than the volume of one of the conduits.

In a preferred embodiment of the first and second aspects of the present invention the device is activated by a portion of the upper layer containing said built-up areas being removed, said removal causing the conduits to become unblocked as a result of the internal pressure created by the viscous substances retained within the conduits.

The device according to the first and/or second aspects of the present invention may further comprise a gutter, which is preferably relatively wide compared to the width of the conduits and is preferably defined by said intermediate layer, said gutter serving to catch any excess material which may be squeezed out of other regions of the device during the lamination and conduit forming processes.

As defined above, the third aspect of the present invention relates to another design of time indicator device comprising a first reservoir containing a first liquid comprising a colourant and a second reservoir containing a second liquid comprising a dispersant for said colourant. A viewing window is associated with said second reservoir, said first and second reservoirs being interconnected by a conduit, and a barrier being provided between at least one of said first and second liquids and said conduit. Importantly, the conduit contains a first substance that is a liquid or gel, and removal of the barrier permits dispersion of said colourant from the first reservoir to the second reservoir over a predetermined time period thereby providing an indication via said viewing window of when said predetermined time period has elapsed.

In a preferred embodiment of the third aspect of the present invention said first substance in the conduit exhibits a higher viscosity than the first and/or second liquids, and removal of the barrier permits said at least one of said first and second liquids to disperse through the first higher viscosity substance until the first and second liquids contact one another and mix to form a first mixture whereupon the colourant disperses throughout said first mixture thereby providing said indication via said viewing window of when said first predetermined time period has elapsed.

The manner in which the above preferred embodiment of the indicator device according to the third aspect of the present invention functions may be summarised as follows. Following activation, at least one of the lower viscosity first and second liquids begins to breakdown and disperse through the higher viscosity substance contained in the conduit connecting the two reservoirs. It will be appreciated that the rate at which dispersion occurs is determined at least in part by the physical and chemical nature of the liquids/substances and the physical form of the conduit. The rate of admixture of the liquids/substances, and therefore ultimately the rate of colourant diffusion, is controlled so as to act as the primary timing mechanism. After a first predetermined period of time the first and second liquids contact, mix and disperse throughout one and allow the colourant to rapidly diffuse through the liquid mixture in the conduit and into the liquid mixture in the first reservoir, at which point the colourant becomes visible via the viewing window associated with the second reservoir, providing a visual indication of when the first predetermined time period has elapsed.

An important feature of the present invention is that tracking of the colourant along the or each conduit can be accurately controlled by appropriate selection of the physical and chemical nature of the various liquids and gels contained in the reservoirs and conduit(s) and the physical form, i.e. shape of the reservoirs and conduit(s). Moreover, the present invention provides that the colourant diffuses rapidly throughout the liquid mixture as soon as the first and second liquids contact and mix with one another regardless of the length of time it has taken the first and second liquids to disperse through the first higher viscosity gel.

It is preferred that said device comprises a third reservoir containing a third liquid comprising a further colourant, said third reservoir being connected to the second reservoir by a further conduit containing a second substance that is a liquid or gel, a further barrier being provided between the third liquid and the further conduit, removal of said further barrier permitting dispersion of said further colourant from the third reservoir to the second reservoir over a second predetermined time period thereby providing an indication via said viewing window of when said second predetermined time period has elapsed.

In a further preferred embodiment of the third aspect of the present invention said second substance in the conduit exhibits a higher viscosity than the third liquid, and removal of said further barrier permits said third liquid to disperse through the second higher viscosity substance until the second and third liquids contact one another and mix to form a second mixture whereupon the further colourant disperses throughout said second mixture thereby providing said indication via said viewing window of when said second predetermined time period has elapsed.

An important feature of the present invention is that a consumer may be presented with a simple to understand "Traffic Light" system of product suitability. When green is viewed through the viewing window this is an indication that the product is still at its best, when amber is viewed the consumer is asked to exercise caution and carefully assess the suitability to use or consume, and when red is viewed the consumer is advised to dispose of the product and re-purchase. Research shows that the "Traffic Light" principal is universally understood across the world, and the present invention is arranged to be able to provide the conventional green to amber to red colour change and the more simplified green to red change, as well as any other desirable colour change(s).

It will be appreciated that the rate of colour change is important in that the product may be perfectly good for an extended period of time, say 28 days, over which period a green indication will be desired, but will rapidly change through the caution state (indicated as amber) to a red condition, say at 30 days, where upon the product is no longer safe for consumption. The present invention provides a means by which the desired rate of colour change can be achieved.

It is preferred that the rate at which the viscosity of the first higher viscosity substance varies with temperature is related to the rate at which the decay of a perishable item, to which the device is applied, varies with temperature. In this way, the time indicator device of the present invention operates correctly and provides the appropriate time indication regardless of whether or not the perishable item is stored in accordance with the manufacturer's directions. By way of example, if the item, once opened, is intended to be refrigerated and stored at around 5° C. but the consumer mistakenly stores the item at ambient temperature, for example in a cupboard, then it is important that the time indicator device of the present invention can take account of the consumer's mistake and still function correctly. Assuming that storing the item at an elevated temperature increases the rate of decay of the item, the first time period and, where applicable, the second time period must be shortened by the appropriate amount to provide the consumer with the correct information. This may be achieved by appropriate selection of the first and, where applicable, the second higher viscosity substances such that the rate at which their viscosity varies with temperature is related to, or more preferably substantially matches the rate at which the decay of the perishable item varies with temperature.

With regard to the time indicator device forming the present invention it is preferred that the viscosity of the first higher viscosity substance provided in the conduit is in the range of around 4000 to around 16000 cP (at 20° C.). More preferably the viscosity of the first higher viscosity substance is in the range of around 6000 to around 14000 cP (at 20° C.), still more preferably in the range of around 10000 to around 14000 cP (at 20° C.), and most preferably around 12000 cP (at 20° C.).

In a preferred embodiment of the present invention the viscosity of at least one of the first and second liquids is greater than around 1 cP (at 20° C.). The viscosity of at least one of the first and second liquids is in the range or around 1 to around 2000 cP (at 20° C.). More preferably the viscosity of at least one of the first and second liquids is in the range of around 50 to around 1500 cP (at 20° C.), yet more preferably in the range of around 500 to around 1500. Most preferably the viscosity of the first liquid is around 1000 to around 1400 cP (at 20° C.) and/or the viscosity of the second liquid is around 1000 to around 1400 cP (at 20° C.).

A ratio of the viscosity of at least one of the first and second liquids compared to the first higher viscosity substance ($1^{st}/2^{nd}$ liq.: $1^{st}$ high. vis. subst.) may lie in the range 1:16000 to 1:2 (at 20° C.), more preferably in the range 1:20 to 1:5 (at 20° C.). It is most preferred that the ratio of the viscosity of at least one of the first and second liquids compared to the first higher viscosity substance is around 1:10 ($1^{st}/2^{nd}$ liq.: $1^{st}$ high. vis. subst.).

Preferably the first higher viscosity substance is substantially miscible with at least one of said first and second liquids. More preferably the first higher viscosity substance is substantially miscible with both of said first and second liquids. In this way, when the first liquid contacts and mixes with the second liquid the first mixture thus formed is an essentially homogeneous mixture of the first and second liquids and the first higher viscosity substance throughout the first and second reservoirs and the interconnecting conduit.

At least one of the first and second liquids may comprise water. Preferably both the first and second liquids comprise water. The first and/or second liquid may comprise around 20 to 70 wt % water, more preferably around 30 to 60 wt % water. Most preferably the first liquid comprises around 50 wt % water and/or the second liquid comprises around 50 wt % water.

At least one of the first liquid, second liquid and the first higher viscosity substance provided in the conduit may comprise a substance selected from the group consisting of carboxymethyl cellulose (or a salt thereof), hydroxyethyl cellulose, glycerol, ethylene glycol, diethylene glycol and mixtures thereof.

In a preferred embodiment of the present invention the first higher viscosity substance comprises a mixture of glycerol and carboxymethyl cellulose and/or hydroxyethyl cellulose. The first substance preferably further comprises water, and may include still further species, such as a biocide. The first higher viscosity substance preferably comprises around 1 to 5 wt % carboxymethyl cellulose, more preferably around 2 to 4 wt % carboxymethyl cellulose, and most preferably around 3 to 4 wt % carboxymethyl cellulose. The first higher viscosity substance preferably comprises around 40 to 90 wt % glycerol, more preferably around 50 to 80 wt % glycerol, and most preferably around 60 to 70 wt % glycerol. The first higher viscosity substance preferably comprises around 10 to 50 wt % water, more preferably around 20 to 40 wt % water, and most preferably around 30 to 40 wt % water.

It is preferred that the colourant is a dye. The dye may take any appropriate colour and should be non-toxic and suitable for use in the desired application. Thus where the indicator device is to be employed on foodstuffs it is desired that the dye is safe for use with edible products. It is particularly preferred that the dye is orange or red since these colours are eminently suitable for application into the device of the present invention to provide a "Traffic Light" colour change pattern, which as mentioned above, is easily and widely understood by consumers. An example of a preferred orange dye is 105101 Duasyn Sauregelb xxSF and an example of a preferred red dye is 105112 Duasyn Saurerhodamin B-SF.

The colourant may be a pigment, which should again be safe to use in the intended application. That is, if the device is to be used on a food product, it is preferred that the pigment is food safe and will not harm a consumer if accidentally ingested.

It is particularly preferred that barriers are provided between the first liquid and the conduit, and the second liquid and the conduit, and removal of the barriers permits the first and second liquids to disperse through the first higher viscosity substance over the predetermined time period until the first and second liquids contact one another. The barrier(s) may be removed in any convenient way. One preferred way is as a result of a user opening a product to which the device is attached.

A surface of the second reservoir is preferably coloured in such a way that the colour of that surface is visible via the viewing window associated with the second reservoir prior to the colourant dispersing throughout the first mixture. In this way, while the colouration provided on the coloured surface is visible the device provides a visual indication to a user that the device has not yet been activated. For example, the coloured surface may be coloured white or green to indicate that a product to which the device has been applied has not yet been opened. Once the device is activated, after the first predetermined time period has elapsed the colourant from the first reservoir would provide colouration (e.g. amber) which masks the white or green background colouration of the coloured surface of the second reservoir. If a third reservoir is provided, after a second predetermined time period the further colourant from the third reservoir would provide colouration (e.g. red) which masks both the white or green background colouration and the previous amber colouration.

In the preferred embodiment of the present invention where the device comprises a third reservoir a further colourant can be dispersed from the third reservoir to the second reservoir over a second time period and thereby provide a visual indication of when the second predetermined time period has elapsed.

The second predetermined time period may be shorter, substantially the same, or longer than the first predetermined time period. If the first and second colourants impart different colouration to the liquid viewable via the viewing window then a user can be presented with a first colour (e.g. orange or amber) after the first time period and a second, different colour (e.g. red) after the second time period.

The viscosity of the second higher viscosity substance provided in the further conduit is in the range of around 4000 to around 16000 cP (at 20° C.). More preferably the viscosity of the second higher viscosity substance is in the range of around 6000 to around 14000 cP (at 20° C.), still more preferably in the range of around 10000 to around 14000 cP (at 20° C.), and most preferably around 12000 cP (at 20° C.).

Preferably the viscosity of the third liquid is greater than around 1 cP (at 20° C.). The viscosity of the third liquid is preferably in the range of around 1 to around 2000 cP (at 20° C.). More preferably the viscosity of the third liquid is in the range of around 50 to around 1500 cP (at 20° C.), yet more preferably in the range of around 500 to around 1500. Most preferably the viscosity of the third liquid is around 1000 to around 1400 cP (at 20° C.).

A ratio of the viscosity of the third liquid compared to the second higher viscosity substance ($3^{rd}$ liq.:$2^{nd}$ high. vis. subst.) may lie in the range 1:16000 to 1:2 (at 20° C.), more preferably in the range 1:20 to 1:5 (at 20° C.). It is most preferred that the ratio of the viscosity of the third liquid compared to the second higher viscosity substance is around 1:10 ($3^{rd}$ liq.:$2^{nd}$ high. vis. subst.).

The second higher viscosity liquid may exhibit a viscosity that is higher, lower or substantially the same as the viscosity of the first higher viscosity liquid. When it is desired to provide a second predetermined time period that is longer than the first predetermined time period, one way in which this can be achieved is by formulating the second substance so as to exhibit a higher viscosity than the first substance. It will be appreciated that a further way in which this can be achieved, either independently of the relative viscosities of the first and second substances or in combination with the second substance exhibiting a higher viscosity than the first substance, is to increase the volume of the second substance relative to the first substance. This may be achieved, for example, by increasing the length of the further conduit connecting the third reservoir to the second reservoir compared to the length of the conduit connecting the first reservoir to the second reservoir, optionally in combination with increasing the depth and/or width of the further conduit connecting the second and third conduits relative to the depth and/or width of the conduit connecting the first and second conduits.

In one preferred embodiment where it is desired that the second predetermined time period is longer than the first predetermined time period, the volumes of the first and second higher viscosity substances is substantially the same, and the viscosity of the second substance is greater than the viscosity of the first substance. In order to provide a "Traffic Light" indicator effect, in this particular embodiment, the second reservoir possesses a surface that is coloured green so as to present a green colouration via the viewing window prior to activation of the device. The first colourant, which initially resides in the first reservoir is an orange dye, such as 105101 Duasyn Sauregelb xxSF, and the second colourant, which initially resides in the third reservoir is a red dye, such as 105112 Duasyn Saurerhodamin B-SF, although it will be appreciated that any suitable orange and red dyes or pigments may be used. When the device is activated, by virtue of the first higher viscosity substance, through which the orange dye must diffuse, being of lower viscosity than the second higher viscosity substance, the orange dye diffuses more quickly to the second reservoir than the red dye. In this way, the user is first presented with a green colouration, followed by an orange colouration after the first predetermined time period has elapsed and finally a red colouration after the expiry of the second predetermined time period.

Preferably the second higher viscosity substance is substantially miscible with at least one of said second and third liquids. Said second higher viscosity substance is preferably substantially miscible with both of said second and third liquids.

It is preferred that the third liquid comprises water. The third liquid may comprise around 20 to 70 wt % water, more preferably around 30 to 60 wt % water. Most preferably the third liquid comprises around 50 wt % water.

The third liquid and/or the second higher viscosity substance provided in the further conduit preferably comprises a substance selected from the group consisting of carboxymethyl cellulose (or a salt thereof), hydroxyethyl cellulose, glycerol, ethylene glycol, diethylene glycol and mixtures thereof.

In a preferred embodiment, the second higher viscosity substance comprises a mixture of glycerol and carboxymethyl cellulose and/or hydroxyethyl cellulose. The second substance preferably further comprises water, and may include still further species, such as a biocide. The second higher viscosity substance preferably comprises around 1 to 5 wt % carboxymethyl cellulose, more preferably around 2 to 4 wt % carboxymethyl cellulose, and most preferably around 3 to 4 wt % carboxymethyl cellulose. The second higher viscosity substance preferably comprises around 40 to 90 wt % glycerol, more preferably around 50 to 80 wt % glycerol, and most preferably around 60 to 70 wt % glycerol. The second higher viscosity substance preferably comprises around 10 to 50 wt % water, more preferably around 20 to 40 wt % water, and most preferably around 30 to 40 wt % water.

It is preferred that the further colourant is a dye. The dye may take any appropriate colour and should be non-toxic and suitable for use in the desired application. It is preferred that the dye is orange or red since these colours are eminently suitable to provide a "Traffic Light" colour change pattern, as described above. An example of a preferred orange dye is 105101 Duasyn Sauregelb xxSF and an example of a preferred red dye is 105112 Duasyn Saurerhodamin B-SF.

The further colourant may be a pigment, which for the reasons outlined above, should be safe to use in the intended application, e.g. with food products.

It should be appreciated that the third aspect of the present invention is not limited to the use of just a single colourant in the first liquid and, where applicable, the third liquid. The first, second and third liquids may each comprise one or more colourants to provide the desired overall colouration properties. In a preferred embodiment, prior to activation of the device, the first and third liquids contain a single dye colourant and the second liquid contains no colourant. In an alternative embodiment, the first, second and third liquids all contain a dye colourant prior to activation of the device. For example, the first liquid may contain an orange dye, the second liquid a green dye and the third liquid a red dye. If the device is arranged such that the first liquid mixes with the second liquid more quickly than the third liquid then the consumer will be presented with a colour sequence in accordance with the well-known '"Traffic Light"' principle, i.e. first green, then orange, then finally red.

Preferably the further barrier is adapted to be removable as a result of opening a product to which the device is attached.

With regard to the first, second and third aspects of the present invention, the or each barrier is preferably defined by a depression formed in a cover layer provided over at least a portion of said device. A surface of the device according to the first, second or third aspects may be provided with adhesive to facilitate attachment of the device to a product. Where the device is incorporated into product packaging, it will be appreciated that the adhesive may be applied to any suitable region of the packaging so afford attachment of the packaging, incorporating the indicator device, to the product. At least one of the reservoirs and the conduit(s) may be formed in a supporting layer by a technique selected from the group consisting of hot forming, embossing, welding, laser ablation, cutting and lamination, printing and etching. At least one of the first and second liquids may be provided in its respective reservoir by a printing process. Where a third, fourth or fifth liquid is employed, it may further be provided in its respective reservoir using a printing process.

The quality and presentation of a clear strong "Traffic Light" colour which changes in line with a time/temperature life profile of a product can only be achieved effectively by means of pH change or dye/pigment diffusion. Other colour change reactions (such as oxidisation), are always two colour changes, and from unsatisfactory parts of the colour spectrum for a "Traffic Light" indication. Furthermore, the rate of colour change provided by these existing two colour systems is inconsistent and gradual in nature forcing the consumer to make a subjective assessment of fitness for use.

As mentioned above, various features of the devices of the various aspects of the present invention can be manipulated to control the rate at which the various liquids dissolve, disperse and flow through the substances (e.g. the liquid or gel) contained in the interconnecting conduit(s) and the rate at which the colourant or acid diffuses throughout the eventual liquid mixture resulting from the different liquids contacting one another and. The features include, but are not necessarily limited to: the viscosity of the liquids and gels; the dimensions of the or each conduit (depth, width, length); the shape of the or each conduit; and the solubility of the or each colourant. As described more fully above, the devices according to the first, second and third aspects of the present invention can incorporate a plurality of partial conduits which can be selectively combined as necessary to define the conduit required to provide the device with the desired timing capability.

By way of example only, the manner in which a device according to the present invention functions, when applied to a jar of mayonnaise will now be described. Upon opening the jar, the device is activated and a green underprint is visible through a clear liquid retained in a target reservoir, informing a consumer that the mayonnaise is good to use. After a first predetermined time period, a mildly acidic solution and/or an amber dye, previously retained in a first source reservoir prior to opening of the jar, discolours the previously clear liquid to an amber colour (covering or masking the green underprint) informing the consumer that the mayonnaise is nearing the end of its usable life, and that caution should be exercised and consideration given to purchasing a replacement jar. After a second longer predetermined time period, a more strongly acidic solution and/or red dye, previously retained in a second source reservoir prior to opening of the jar, overpowers the orange dye and discolours the liquid in the target reservoir to a strong red colour, thereby informing the consumer that the mayonnaise is no longer safe to use and should be discarded. The amber warning period gives the consumer notice that the product is approaching the end of its useful life, thereby allowing the consumer to avoid running out of an important product without notice.

The presentation of the freshness or fitness for use indication to a consumer uses the '"Traffic Light"' convention, in that a green observable target on a product is seen as good, fit, or fresh, and a red target is seen as bad, unfit, or due for disposal. Embodiments of the invention allow for a simple two colour green to red colour change, or alternatively a more complex three colour green to amber to red colour change. The benefits of the triple colour system are that the consumer is presented with an 'early warning' which acts as a stimulus to re-purchase the product before the current product becomes unsuitable for use.

The invention will now be further described, by way of example only, with reference to the following specific embodiment and Examples, in which.

Figure 1:
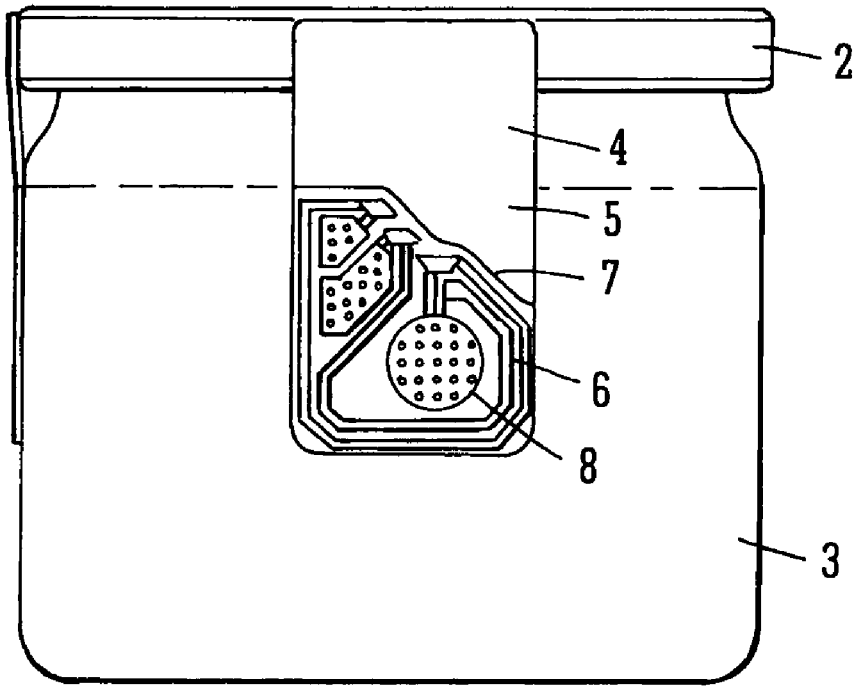
FIG. 1 is a schematic representation of a time indicator device according to a preferred embodiment of the third aspect of the present invention in the form of a label applied to a container.
Figure 4:
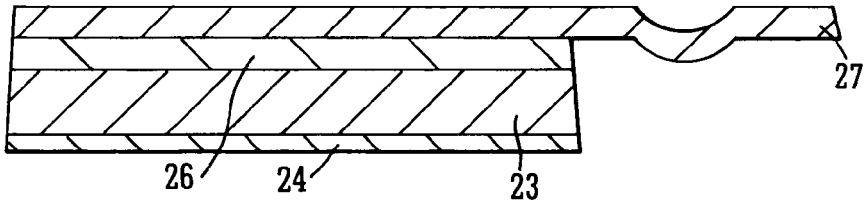
FIG. 4 is a schematic representation in cross section of a first part of the device shown in FIG. 1 which remains connected to a lid of the container after the container is opened.
Figure 5:
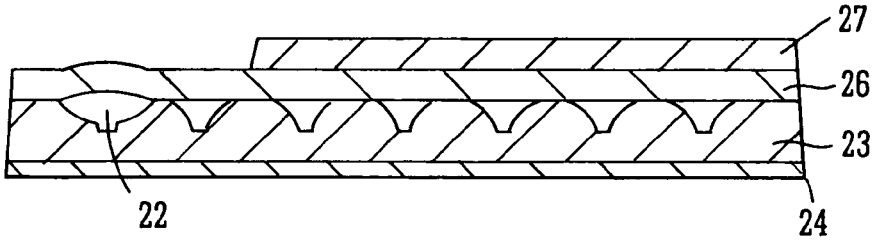
FIG. 5 is a schematic representation in cross section of a second part of the device shown in FIG. 1 which remains connected to a body of the container after the container is opened.

Referring to FIG. 1, there is shown a container 1 suitable to retain a food item, which comprises a twist-off lid 2 and a body 3. A time indicator device according to a preferred embodiment of the present invention is shown in the form of a label 4 connected to both the lid 2 and body 3 of the container 1. The label 4 comprises an upper section 5 in the form of a peelable tab which is connected using an adhesive (not shown) to the lid 2 of the container 1 and a lower section 6 in the form of a permanent patch which is connected using an adhesive (not shown) to the body 3 of the container 1. The upper and lower sections 5, 6 of the label 4 are joined together along a frangible seam 7, such that when the lid 2 of the container 1 is unscrewed from the body 3 of the container 1 the upper and lower sections 5, 6 of the label 4 separate along the seam 7. Once opened, the upper section 5 of the indicator label 4 remains adhered to the lid 2 of the container 1, the lower section 6 of the label 4 remains adhered to the body 3 of the container 1 and the label 4 is activated. The manner in which activation of the label 4 is achieved is explained in more detail below with reference to FIGS. 3, 4 and 5. The lower section 6 of the label 4 incorporates a viewing window 8 through which different colouration can be observed to provide a user of the container 1 with a visible indication of the freshness of the contents of the container 1.

Figure 2:
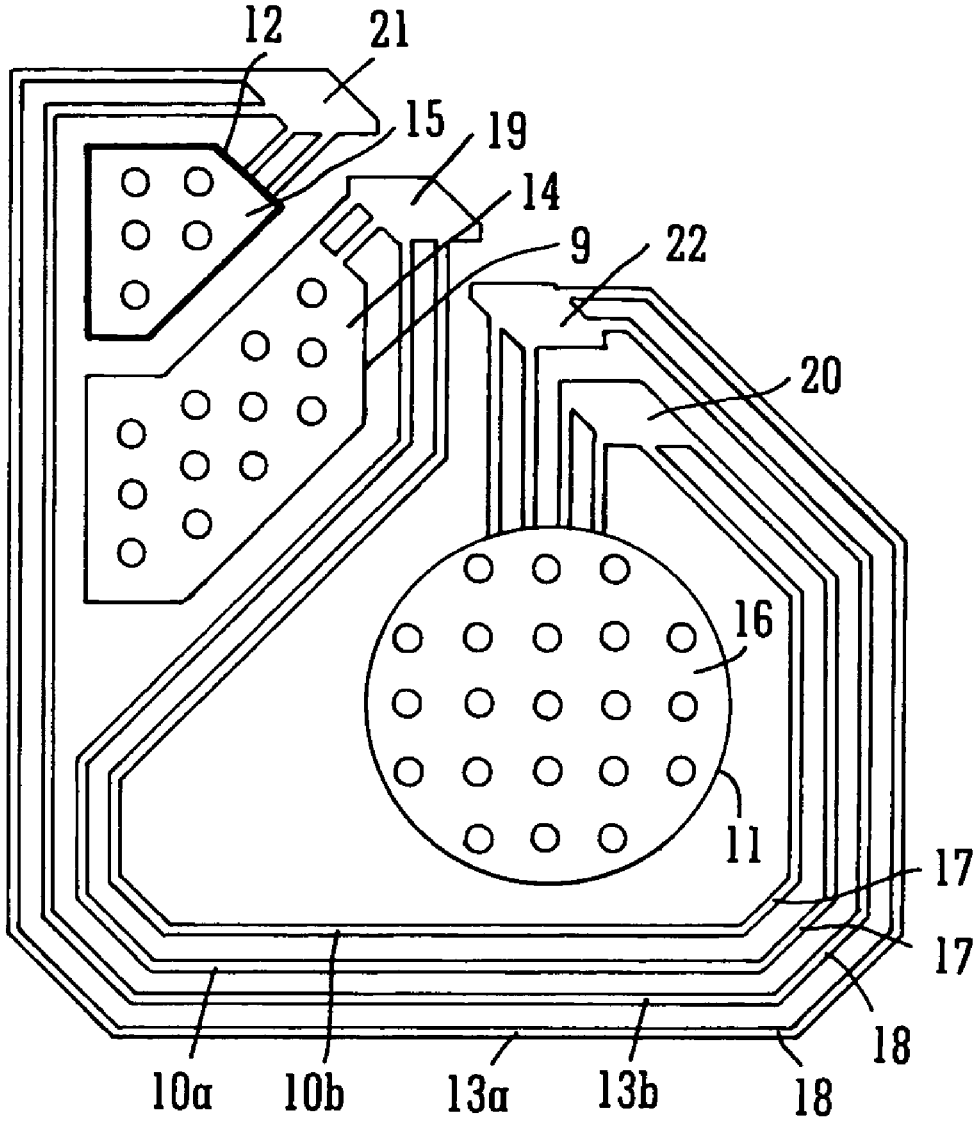
FIG. 2 is a schematic representation of a lower section of the device shown in FIG. 1.

Referring now to FIG. 2, the key components of the label 4 of FIG. 1 which provide the visible indication of the freshness of the contents of the container 1 are shown in greater detail. The components comprise a first dye source reservoir 9 which is connected via a first set of conduits 10*a*, 10*b* to a target reservoir 11. A second dye source reservoir 12 is also connected to the target reservoir 11 via a separate second set of, longer, conduits 13*a*, 13*b*. A first low viscosity liquid mixture 14 including water, ethylene glycol, glycerol and carboxymethyl cellulose with a relatively high water content and further comprising an orange dye (105101 Duasyn Sauregelb xxSF) and minor amounts of other additives (co-solvent, thickener, deformer and biocide) is retained in the first dye source reservoir 9 and a second low viscosity liquid mixture 15 including water, ethylene glycol, glycerol and carboxymethyl cellulose with a relatively high water content and further comprising a red dye (105112 Duasyn Saurerhodamin B-SF) and minor amounts of other additives (co-solvent, thickener, deformer and biocide) is retained in the second dye source reservoir 12 prior to activation of the label 4. A third low viscosity liquid mixture 16 is provided in the target reservoir 11. The third low viscosity liquid mixture is a relatively dilute aqueous solution of ethylene glycol, glycerol, carboxymethyl cellulose and minor amounts of other additives (co-solvent, thickener, deformer and biocide) but with no colourant added such that the third low viscosity liquid mixture 16 is clear. The first and/or second and/or third low viscosity mixtures 14, 15, 16 optionally include hydroxyethyl cellulose in addition to carboxymethyl cellulose or instead of carboxymethyl cellulose. The third low viscosity liquid mixture liquid acts as a dispersant for the dye colourants contained in the first and second low viscosity liquid mixtures 14, 15 since as soon as the third low viscosity liquid mixture 16 contacts and mixes with the first and second low viscosity liquid mixtures 14, 15 to form a further liquid mixture (not shown) the dyes previously contained in the first and second liquid mixtures 14, 15 disperse throughout the further liquid mixture. The lowermost surface of the target reservoir 11 is provided with a green colouration, which is initially visible via the viewing window 8 (see FIG. 1) because the viewing window 8 overlies the target reservoir 11 and the third low viscosity liquid mixture 16 is clear.

The conduits 10*a*, 10*b* connecting the first dye source reservoir 9 to the target reservoir 11 are filled with a first high viscosity gel 17 comprising a relatively concentrated aqueous mixture of glycerol and carboxymethyl cellulose (in alternative embodiments the carboxymethyl cellulose may be replaced or supplemented with hydroxyethyl cellulose), and the conduits 13*a*, 13*b* connecting the second dye source reservoir 12 to the target reservoir 11 are filled with a second high viscosity gel 18 comprising a relatively concentrated aqueous mixture of glycerol and carboxymethyl cellulose (in alternative embodiments the carboxymethyl cellulose may be replaced or supplemented with hydroxyethyl cellulose).

A first barrier region 19 is provided in conduits 10*a*, 10*b* near to the first dye source reservoir 9 and a second barrier region 20 is provided in conduits 10*a*, 10*b* near to the target reservoir 11. A third barrier region 21 is provided in conduits 13*a*, 13*b* near to the second dye source reservoir 12, and a fourth barrier region 22 is provided in conduits 13*a*, 13*b* near to the target reservoir 11. The function of the barrier regions 19, 20, 21, 22 will be explained in more detail below with reference to FIGS. 3, 4 and 5.

Figure 3:
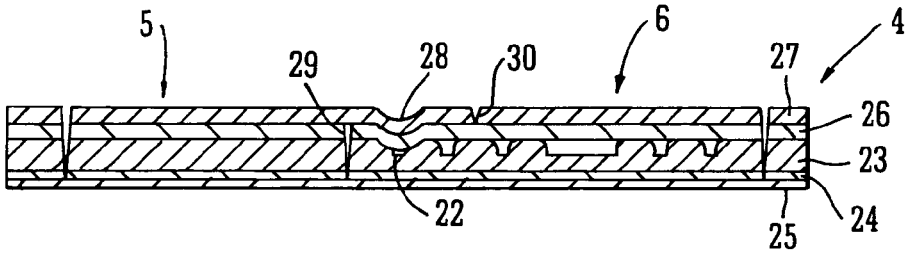
FIG. 3 is a schematic representation in cross section of the device shown in FIG. 1.

Now with reference to FIG. 3, there is shown a schematic cross sectional view of the label 4 prior to activation (as shown in FIG. 1). The upper and lower sections 5, 6 of the label 4 are indicated to aid comparison of FIG. 3 to FIGS. 1 and 2. The label 4 comprises a substrate layer 23 of, for example, polypropylene. The substrate layer 23 has been embossed so as to define the first and second dye store reservoirs 9, 12, the target reservoir 11, the interconnecting conduits 10*a*, 10*b*, 13*a*, 13*b*, and the barrier regions 19, 20, 21, 22. The substrate layer 23 is provided with a layer of adhesive 24 to permit attachment of the label 4 to the container 1. The adhesive layer 24 is provided with a glassine protective layer 25 to protect the adhesive layer 24 prior to application to the container 1 but which can be peeled away immediately prior to attachment of the label 4 to the container 1. A barrier layer 26 is laminated over the substrate layer 23 and an outermost clear peelable layer 27 is laminated over the barrier layer 26.

The method of lamination of the outermost layer 27 is such that a series of de- bosses 28 are formed in the outermost layer 27 which overlie the barrier regions 19, 20, 21, 22 formed in the substrate layer (only barrier region 22 is visible in FIG. 3). In this way, the de-bosses 28 deform the underlying barrier layer 26 downwardly into the barrier regions 19, 20, 21, 22 and thereby prevent the first, second and third low viscosity liquid mixtures 14, 15, 16 in the two source reservoirs 9, 12 and the target reservoir 11 from contacting the high viscosity gels 17, 18 in the conduits 10*a*, 10*b*, 13*a*, 13*b* until the label 4 is activated.

Activation of the time indicator label 4 is initiated by the consumer unscrewing the lid 2 of the container 1. This results in the label 4 fracturing along the seam 7 and thereby separating the upper and lower sections 5, 6 of the label 4 to provide the two sections 5, 6 as shown separately in FIGS. 4 and 5 respectively. Separation of the two sections 5, 6 of the label 4 is controlled by the provision of a back cut 29 through the adhesive, substrate and barrier layers 25, 24, 26 above the de-bosses 28 and a partial cut through the outermost layer 27 below the de-bosses 28. As the upper section 5 of the label 4 is twisted away from the lower section 6 (by the consumer unscrewing the lid 2 of the container 1) the de-bosses 28 formed in the outermost layer 27 are urged away from the underlying barrier layer 26 thereby freeing the barrier layer 26 to deform upwardly away from the barrier regions 19, 20, 21, 22 and permitting the liquid mixtures 14, 15, 16 to contact and mix with the higher viscosity gels 17, 18 contained in the conduits 10*a*, 10*b*, 13*a*, 13*b*.

As the low viscosity liquid mixtures 14, 15, 16 mix with the high viscosity gels 17, 18 new lower viscosity mixtures are formed in the conduits 10*a*, 10*b* and 13*a*, 13*b*. At the same time the dyes 14, 15 begin to diffuse through the new lower viscosity mixtures and along the conduits 10*a*, 10*b* and 13*a*, 13*b* towards the target reservoir 11. After a first predetermined time period the first low viscosity mixture 14 contacts the third low viscosity mixture 16 to form a single essentially homogeneous liquid mixture throughout the first dye source reservoir 9, conduits 10*a*, 10*b* and the target reservoir 11 and the orange dye diffuses rapidly throughout the homogeneous liquid mixture to provide an orange colouration in the target reservoir 11 which is visible via the viewing window 8. After a second predetermined time a similar process occurs in the second set of conduits 13*a*, 13*b* such that the red dye diffuses throughout a further essentially homogeneous liquid mixture which has been formed throughout the second dye source reservoir 12, conduits 13*a*, 13*b* and the target reservoir 11. Since the red dye is a stronger colour than the orange dye, and the orange dye is a stronger colour than the initial colouration provided on the lowermost surface of the target reservoir 11 then a "'Traffic Light'" effect can be observed via the viewing window 8. In summary, initially, the green colouration is visible through the viewing window 8 denoting that the contents of the container 1 are safe to consume. After the first predetermined time period, the orange dye discolours the target reservoir 11, presenting a visible amber colouration denoting that the contents of the container may soon not be safe to consume, and after the second predetermined time period, the red dye discolours the (already discoloured) target reservoir 11, presenting a vivid red colouration indicating that the contents of the container 1 are no longer safe to consume.

Figure 6:
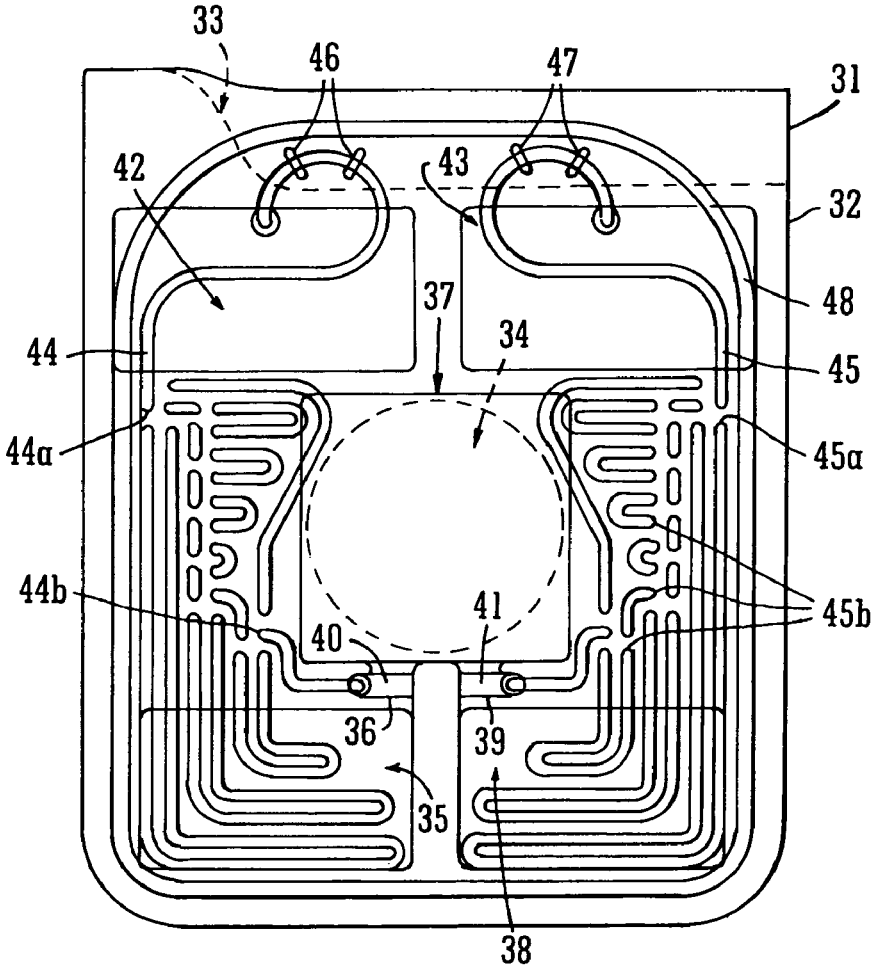
FIG. 6 is a schematic representation of a time indicator device according to a preferred embodiment of the first and second aspects of the present invention in the form of a label which can be applied to a container.
Figure 7:
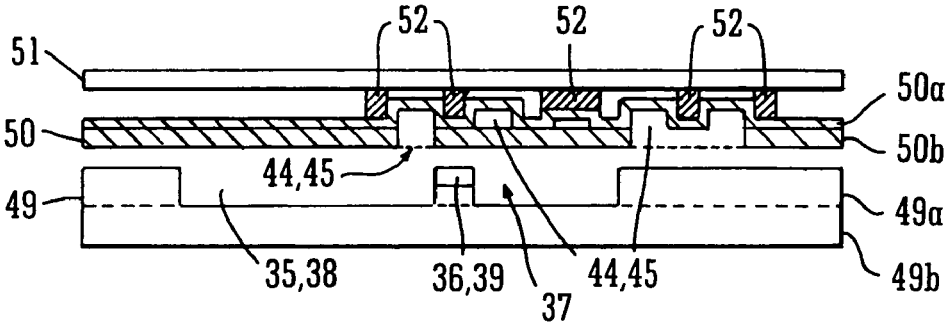
FIG. 7 is a schematic representation in cross section of the device shown in FIG. 6.

Referring now to FIGS. 6 and 7, there is shown a time indicator device according to a preferred embodiment of the first and second aspects of the present invention in the form of a label 30 which is suitable to be connected to both a lid and body of a container (not shown) so that it can be activated in an analogous fashion to the label 4 described above with reference to FIGS. 1 to 5.

The label 30 in FIGS. 6 and 7 comprises an upper section 31 in the form of a peelable tab which is to be connected using an adhesive (not shown) to the lid of the container and a lower section 32 in the form of a permanent patch which is to be connected using an adhesive (not shown) to the body of the container. The upper and lower sections 31, 32 of the label 30 are joined together along a frangible seam 33, such that when attached to the container and the lid of the container is unscrewed the upper and lower sections 31, 32 of the label 30 separate along the seam 33. Once opened, the upper section 31 of the indicator label 30 remains adhered to the lid of the container, the lower section 32 of the label 30 remains adhered to the body of the container and the label 30 is activated. Activation of the label 30 described in more detail below. The lower section 32 of the label 30 incorporates a viewing window 34 through which different colouration can be observed to provide a user with a visible indication of the freshness of the contents of the container.

As shown in FIG. 6, the label 30 incorporates a first acid-containing reservoir 35 which is connected via a first short relatively wide conduit 36 to a target reservoir 37 which lies immediately beneath the viewing window 34. In this way, the viewing window 34 enables a user to determine the colour of liquid present within the target reservoir 37. A second acid-containing reservoir 38 is also connected to the target reservoir 37 via a separate second relatively short conduit 39. Each short, wide conduit 36, 39 is initially blocked by an enzymatically degradable barrier 40, 41 to prevent the acidic solutions (not shown) escaping from their respective reservoirs 35, 38 into the target reservoir 37. Connecting the two acid-containing reservoirs 35, 38 to the target reservoir 37 via short relatively wide conduits 36, 39 ensures that passage of the acidic solutions from their respective reservoirs 35, 38 to the target reservoir 37 is rapid once the barriers 40, 41 within each conduit 36, 39 have been removed. This is important is ensuring the user is provided with a quick, reliable colour change as soon as a predetermined time period has elapsed.

Each of the enzymatically degradable barriers 40, 41 is in fluid communication with a respective enzyme-containing source reservoir 42, 43 via a dedicated set of relatively long, narrow conduits 44, 45 respectively. As is clearly visible in FIG. 6, each conduit 44, 45 is comprised of a series of shorter partial conduits 44A, 44B and 45A, 45B respectively which are selectively connected together during assembly of the various component parts of the label 30 to define single conduits 44, 45 of the desired length extending from the enzyme-containing source reservoirs 42, 43 to the enzymatically degradable barriers 40, 41. In this way, a single set of partial conduits can be used to define a plurality of conduits of differing length to suit the intended application of the label 30. An important factor in determining the predetermined time periods indicated by the label 30 is the length of each conduit 44, 45 linking the source reservoirs 42, 43 to their respective barriers 40, 41. Clearly, all other factors being equal, it will take a longer period of time for the enzyme-containing solution to travel along a longer conduit 44, 45 connecting the source reservoir 42, 43 to the barrier 40, 41.

Two pairs of barriers 46, 47 are provided across the conduits 44, 45 respectively to prevent enzyme-containing liquid flowing out of the source reservoirs 42, 43 until such time as the label 30 is activated. Upon opening of the container to which the label 30 is attached, as mentioned above, the upper portion 31 of the label 30 tears away from the lower portion 32 along the seam 33. The pairs of barriers 46, 47 blocking the conduits 44, 45 are connected to the upper portion 31 of the label 30 and so, as the upper portion 31 of the label 30 is removed, so too are the pairs of barriers 46, 47. The enzyme-containing liquids initially resident in each source reservoir 42, 43 are then free to flow out of their respective reservoir 42, 43 along their respective conduit 44, 45 to their designated enzymatically degradable barrier 40, 41. One way in which two different time periods can be indicated by the label 30 is by assembling the label 30 so that one of the conduits 44, 45 is shorter than the other. In this way, it will take less time for one of the acid-containing solutions to travel from its reservoir 42, 43 to its barrier 40, 41 than the other acid-containing solution (assuming all other factors relating to the two solutions and the contents of the conduits are equal).

As can be seen in FIG. 6, the label 30 is also provided with a gutter 48 extending around the periphery of the label 30. This is to catch any excess fluids forced out of the label 30 during its assembly which might otherwise hamper the correct functioning of the label 30. This also ensures that each region of the label 30 can be completely filled with the appropriate liquid or substance to ensure that no potentially problematic air pockets remain within the structure of the label 30 after assembly.

The first acid-containing reservoir 35 contains a first low viscosity liquid mixture including water, acid to pH 3, an orange dye (e.g. 105101 Duasyn Sauregelb xxSF), and optionally a fluorescent species, exothermic reagents and/or minor amounts of other additives (co-solvent, thickener, deformer and biocide). This liquid mixture possesses a pH of 3 and a viscosity of 10 cP (at 20° C.). The second acid-containing reservoir 38 contains a second low viscosity liquid mixture including water, acid to pH 1.5, a red dye (e.g. 105112 Duasyn Saurerhodamin B-SF), and optionally a fluorescent species, exothermic reagents and/or minor amounts of other additives (co-solvent, thickener, deformer and biocide). This liquid mixture possesses a pH of 1.5 and a viscosity of 10 cP (at 20° C.).

The target reservoir 37 contains a third low viscosity liquid mixture including water, Universal pH indicator solution, no dye or pigment, and optionally a fluorescent species, exothermic reagents and/or minor amounts of other additives (co-solvent, thickener, deformer and biocide). This liquid mixture possesses a pH of 7 (and is therefore green due to the pH indicator) and a viscosity of 10 cP (at 20° C.).

The third low viscosity liquid mixture liquid acts as a dispersant for the dye colourants contained in the first and second low viscosity liquid mixtures since as soon as the third low viscosity liquid mixture contacts and mixes with the first and second low viscosity liquid mixtures to form first and then second liquid mixtures the dyes previously contained in the first and second liquid mixtures disperse throughout the liquid mixtures.

The enzyme-containing source reservoirs 42 43 each contain liquids comprising an aqueous saline solution and lipase enzyme. Each solution possesses a pH of 7.5 and a viscosity of 10 cP (at 20° C.).

The enzymatically degradable barriers 40, 41 which initially separate the acid-containing reservoirs 35, 38 from the target reservoir 37 are each comprised of a lipid, hard palm kernel oil, and a dehydrated lipase enzyme. The barrier material is at pH 7 and possesses a viscosity of over 16000 cP (at 20° C.).

The conduits 44, 45 connecting the enzyme-containing source reservoirs 42, 43 to the degradable barriers 40, 41 are filled with a high viscosity gel comprising a relatively concentrated aqueous mixture of glycerol and carboxymethyl cellulose (in alternative embodiments the carboxymethyl cellulose may be replaced or supplemented with hydroxyethyl cellulose). The substance contained in the conduits 44, 45 is at pH 7 and possesses a viscosity of 1400 cP (at 20° C.).

As depicted in FIG. 7, the label 30 is a multi-layer construction, comprising a base layer 49 formed of an impermeable material, and constructed from a lamination of two component materials 49A, 49B. The base layer 49 defines the reservoirs 35, 37, 38, 42, 43 within which the various liquids are initially retained before activation of the label 30. The base layer 49 also defines the relatively short and wide conduits 36, 39 linking the acid-containing reservoirs 35, 38 to the target reservoir 37 and which contain the lipid barriers 40, 41.

An intermediate layer 50, again formed from an impermeable material, and constructed from a lamination of two component materials 50A, 50B defines the conduits 44, 45 which link the reservoirs 35, 38, 42, 43.

An upper layer 51, again formed from an impermeable material, has built up areas 52 on its underside facing the intermediate layer 50, which, when laminated to the intermediate layer 50, serve to compress and block selected areas of the conduits 44, 45 defined by the intermediate layer 50 to prevent or delay the movement of liquids within the label 30 until the desired moment of activation.

In operation the label 30 works as follows, when a product upon which the label 30 is being used is opened a portion of said upper layer 51 is removed from the remainder of the label 30, said portion containing the built up areas 52 corresponding to the barriers 46, 47 which had previously blocked the conduits 44, 45 leading from the saline enzyme solution-containing reservoirs 42, 43. Upon removal of the barriers 46, 47, the saline enzyme solution begins to mix with the high viscosity substance within the conduits 44, 45.

As the high viscosity substance becomes more hydrated, its viscosity is reduced, thereby easing passage of the saline solution and the enzymes along the conduits 44, 45. After a first predetermined period of time (said time being determined by a combination of the initial viscosity of the high viscosity substance, the concentration of salt in the saline solution, the relative volumes of saline solution and constituents of the high viscosity substance and the size, cross-section and length of the conduits 44, 45) the saline solution containing the enzyme from one of the reservoirs 42 reaches the conduit 36 containing the hard palm kernel oil barriers 40, at which point the enzyme digests the oil, thereby removing the barriers 40 and allowing the acidic dye solution to pass quickly (since conduit 36 is short and wide) from the acid-containing reservoir 35 into the target reservoir 37. When this occurs two effects are observed by a user via the viewing window 34, firstly, a colour change is effected by the presence of the amber dye, and secondly, the increased acidity causes the pH indicator solution within the target reservoir 37 to change from a neutral, green colour to an amber colour indicating a weakly acidic solution. After a second predetermined period of time, the enzyme solution from the other reservoir 43 reaches the other conduit 39 containing a hard palm kernel oil barrier 41 at which point the process described above is repeated, this time admitting a red dye into the target reservoir 37, overpowering the amber colouration, and the further increase in acidity causing the pH indicator to display a red colouration, indicative of a stronger acid.

EXAMPLES

Examples of three time indicator devices according to the third aspect of the present invention have been fabricated and tested as described below. The physical structure of each device was as described above with reference to FIGS. 1 to 5 and so will not be further described in detail below. The discussion which follows is therefore focused on the chemical and physical properties of the liquids and gels employed in the three devices under test. The results of the tests provided the dye diffusion times for each device and showed the dependence of dye diffusion time on viscosity of the various liquids and gels employed.

Test devices were fabricated so as to have the same basic structure as follows:

| | Area/mm$^2$ | Volume/mm$^3$ |
|---|---|---|
| Red Source Reservoir | 23.497 | 1.175 |
| Orange Source Reservoir | 51.625 | 2.581 |
| Target Reservoir | 84.477 | 4.224 |

| | Length/mm | Volume/mm$^3$ |
|---|---|---|
| Conduit 1 Red Source to Target | 105.68 | 2.241 |
| Conduit 2 Red Source to Target | 96.81 | 2.064 |
| Conduit 3 Orange Source to Target | 78.51 | 1.980 |
| Conduit 4 Orange Source to Target | 74.09 | 1.874 |

Raw Material Preparations

A red dye source solution (red ADS), orange dye source solution (orange ADS), and target solution (target ADS) were prepared along with two viscosity levels of the High Viscosity Media (HVM), with the following compositions:

Source 1 (Red ADS)

| Substance | Description | Mass/g | wt % |
|---|---|---|---|
| Distilled Water | Base | 743.0 | 74.30 |
| 105112 Duasyn Saurerhodamin B-SF | Red Dye | 99.1 | 9.91 |
| Ethylene Glycol | Humectant | 63.1 | 6.31 |
| Iso-Propanol | Co-Solvent | 36.0 | 3.60 |
| SER-AD FX 1070 | Thickener | 54.1 | 5.41 |
| Surfynol 2502 | Deformer | 4.5 | 0.45 |
| Proxel GXL | Biocide | 0.2 | 0.02 |

Source 2 (Orange ADS)

| Substance | Description | Mass/g | wt % |
|---|---|---|---|
| Distilled Water | Base | 743.0 | 74.30 |
| 105101 Duasyn Sauregelb xxSF | Orange Dye | 99.1 | 9.91 |
| Ethylene Glycol | Humectant | 63.1 | 6.31 |
| Iso-Propanol | Co-Solvent | 36.0 | 3.60 |
| SER-AD FX 1070 | Thickener | 54.1 | 5.41 |
| Surfynol 2502 | Deformer | 4.5 | 0.45 |
| Proxel GXL | Biocide | 0.2 | 0.02 |

Target (Clear ADS)

| Substance | Description | Mass/g | Wt % |
|---|---|---|---|
| Distilled Water | Base | 842.1 | 84.21 |
| Ethylene Glycol | Humectant | 63.1 | 6.31 |
| Iso-Propanol | Co-Solvent | 36.0 | 3.60 |
| SER-AD FX 1070 | Thickener | 54.1 | 5.41 |

-continued

| Substance | Description | Mass/g | Wt % |
|---|---|---|---|
| Surfynol 2502 | Deformer | 4.5 | 0.45 |
| Proxel GXL | Biocide | 0.2 | 0.02 |

HVM 6000

| Substance | Mass/g | wt % |
|---|---|---|
| Distilled Water | 397.5 | 19.87 |
| Glycerol (G6278, Sigma Aldrich) | 1558.0 | 77.90 |
| Blanose CMC* (Type 7L Aqualon) | 44.2 | 2.21 |
| Proxel GXL biocide | 0.4 | 0.02 |

*carboxymethyl cellulose

HVM 12000

| Substance | Mass/g | wt % |
|---|---|---|
| Distilled Water | 874.5 | 43.72 |
| Glycerol (G6278, Sigma Aldrich) | 1028.0 | 51.40 |
| Blanose CMC* (Type 7L Aqualon) | 97.2 | 4.86 |
| Proxel GXL biocide | 0.4 | 0.02 |

*carboxymethyl cellulose

Example 1

A first device employed conduits filled with a high viscosity media gel exhibiting a viscosity of 6000 cp (at 20° C.) (HMV 6000).

The red dye source liquid provided in the red dye source reservoir prior to activation of the device consisted of a mixture of 24 wt % Red ADS and 76 wt % HMV 12000 (viscosity=1400 cp (at 20° C.)). The orange dye source liquid provided in the orange dye source reservoir prior to activation of the device consisted of a mixture of 24 wt % Orange ADS and 76 wt % HMV 12000 (viscosity=1400 cp (at 20° C.)). The target solution provided in the target reservoir prior to activation of the device consisted of a mixture of 24 wt % Clear ADS and 76 wt % HMV 12000 (viscosity=1400 cp (at 20° C.)).

The device exhibited the following dye diffusion times (DDTs) along conduits 1 and 2 connecting the red dye source reservoir to the target reservoir and along conduits 3 and 4 connecting the orange dye source reservoir to the target reservoir:

| | DDT/days |
|---|---|
| Conduit 1 Red Source to Target | 52.84 |
| Conduit 2 Red Source to Target | 48.40 |
| Conduit 3 Orange Source to Target | 39.25 |
| Conduit 4 Orange Source to Target | 37.05 |

Example 2

A second device employed conduits filled with a high viscosity media gel exhibiting a viscosity of 12000 cp (at 20° C.) (HMV 12000).

The red dye source liquid provided in the red dye source reservoir prior to activation of the device consisted of a mixture of 24 wt % Red ADS and 76 wt % HMV 12000 (viscosity=1400 cp (at 20° C.)). The orange dye source liquid provided in the orange dye source reservoir prior to activation of the device consisted of a mixture of 24 wt % Orange ADS and 76 wt % HMV 12000 (viscosity=1400 cp (at 20° C.)). The target solution provided in the target reservoir prior to activation of the device consisted of a mixture of 24 wt % Clear ADS and 76 wt % HMV 12000 (viscosity=1400 cp (at 20° C.)).

The device exhibited the following dye diffusion times (DDTs) along conduits 1 and 2 connecting the red dye source reservoir to the target reservoir and along conduits 3 and 4 connecting the orange dye source reservoir to the target reservoir:

| | DDT/days |
|---|---|
| Conduit 1 Red Source to Target | 66.05 |
| Conduit 2 Red Source to Target | 60.51 |
| Conduit 3 Orange Source to Target | 49.07 |
| Conduit 4 Orange Source to Target | 46.31 |

Example 3

To establish and assess further speed control, the viscosity of the source liquids was lowered whilst using the high viscosity media gel exhibiting a viscosity of 12000 cp (at 20° C.) (HMV 12000) in the conduits of the third test device.

The red dye source liquid provided in the red dye source reservoir prior to activation of the device consisted of a mixture of 24 wt % Red ADS and 76 wt % HMV 6000 (viscosity=701 cp (at 20° C.)). The orange dye source liquid provided in the orange dye source reservoir prior to activation of the device consisted of a mixture of 24 wt % Orange ADS and 76 wt % HMV 6000 (viscosity=701 cp (at 20° C.)). The target solution provided in the target reservoir prior to activation of the device consisted of a mixture of 24 wt % Clear ADS and 76 wt % HMV 6000 (viscosity=701 cp (at 20° C.)).

The above construction provided reduced DDTs. While the applicant does not wish to be bound by any particular theory it is believed that this effect was due to the larger viscosity differential between the HVM filling the conduits, and the source and target liquids, thereby increasing the dissolution action (osmotic pressure) and speeding up the reaction and DDTs.

The invention claimed is:

1. A time indicator device comprised of first and second interconnected reservoirs containing first and second liquids respectively, a first barrier being provided between said first and second liquids to prevent said liquids mixing, wherein said first barrier is connected via a conduit to a third reservoir containing a third liquid which is adapted to pass along said conduit over a first predetermined time period and to effect removal of said first barrier upon contact to facilitate mixing of said first and second liquids and generation of a first liquid mixture within the second reservoir of different color to the second liquid prior to mixing and thereby provide an indication of when said first predetermined time period has elapsed.

2. A time indicator device according to claim 1, wherein a second barrier is provided between the third reservoir and the conduit.

3. A time indicator device according to claim 2, wherein the second barrier is adapted such that, upon removal, the first predetermined time period is initiated by permitting the passage of the third liquid along the conduit.

4. A time indicator device according to claim 2, wherein said second barrier is adapted to be removable as a result of opening a product to which the device is attached or as a result of attaching the device to a product.

5. A time indicator device according to claim 1, wherein the first barrier comprises a chemically and/or enzymatically degradable substance.

6. A time indicator device according to claim 5, wherein the viscosity of the degradable substance comprised in the first barrier is at least 2000 cP (at 20° C.) and/or the degradable substance possesses a melting point above around 60° C.

7. A time indicator device according to claim 5, wherein the first barrier comprises a dehydrated enzyme capable, upon hydration, of degrading the degradable substance comprised in the first barrier.

8. A time indicator device according to claim 5, wherein the third liquid comprises a chemical species or enzyme capable of degrading the degradable substance comprised in the first barrier.

9. A time indicator device according to claim 1, wherein the conduit contains a first substance that is a liquid or gel.

10. A time indicator device according to claim 9, wherein said first substance in the conduit exhibits a higher viscosity than the first and/or second liquids.

11. A time indicator device according to claim 9, wherein the first substance comprises carboxymethyl cellulose or a salt thereof, hydroxyethyl cellulose, glycerol, ethylene glycol, diethylene glycol or a mixture thereof.

12. A time indicator device according to claim 9, wherein the third liquid is substantially miscible with the first substance.

13. A time indicator device according to claim 9, wherein the third liquid comprises a solvent or dispersant for the first substance.

14. A time indicator device according to claim 1, wherein the first liquid comprises a sufficient quantity of an acid such that, after mixing with the second liquid, the resulting liquid mixture within the second reservoir has a different pH than the second liquid prior to mixing, or such that, after mixing with the second liquid, the resulting liquid mixture within the second reservoir possesses a pH of less than 7.

15. A time indicator device according to claim 1, wherein the first liquid comprises a colorant and/or the second liquid comprises a pH indicator species.

16. A time indicator device according to claim 1, wherein said conduit possesses a predetermined length which defines a distance over which the third liquid must pass from the third reservoir to contact the first barrier, said distance at least partly determining said first predetermined time period.

17. A time indicator device according to claim 1, wherein the device defines a plurality of partial conduits which are selectively connectable to form said conduit with said predetermined length.

18. A time indicator device according to claim 1, wherein the device comprises a fourth reservoir connected to the second reservoir, said fourth reservoir containing a fourth liquid, a third barrier being provided between said fourth liquid and the second liquid within the second reservoir to prevent said liquids mixing, said third barrier being connected via a further conduit to a fifth reservoir containing a fifth liquid which is adapted to pass along said further conduit over a second longer predetermined time period and to effect removal of said third barrier upon contact to facilitate mixing of said fourth liquid with said first liquid mixture within the second reservoir and generation of a second liquid mixture within the second reservoir of different color to the first liquid mixture and thereby provide an indication of when said second predetermined time period has elapsed.

19. A time indicator device according to claim 18, wherein a fourth barrier is provided between the fifth reservoir and the further conduit.

20. A time indicator device according to claim 19, wherein the fourth barrier is adapted such that, upon removal, the second predetermined time period is initiated by permitting the passage of the fifth liquid along the further conduit.

21. A time indicator device according to claim 18, wherein said further conduit possesses a second predetermined length which defines a second distance over which the fifth liquid must pass from the fifth reservoir to contact the third barrier, said second distance at least partly determining said second predetermined time period.

22. A time indicator device according to claim 18, wherein the device defines a plurality of partial further conduits which are selectively connectable to form said further conduit with said second predetermined length.

23. A device according to claim 1, wherein the or each barrier is defined by a depression formed in a cover layer provided over at least a portion of said device.

24. A device according to claim 1, wherein a surface of the device is provided with adhesive to facilitate attachment of the device to a product.

25. A device according to claim 1, wherein at least one of said reservoirs and the conduit is formed in a supporting layer.

* * * * *